United States Patent [19]

Obata et al.

[11] 3,932,722

[45] Jan. 13, 1976

[54] PUSH BUTTON BODY FOR A PUSH-BUTTON SWITCH PROVIDING SNAP-ACTION OF THE SWITCH

[75] Inventors: Akira Obata; Takashi Saito, both of Koriyama, Japan

[73] Assignee: Nippo Communication Industrial Co., Ltd., Japan

[22] Filed: Apr. 16, 1974

[21] Appl. No.: 461,369

[52] U.S. Cl. ..... 200/340; 200/159 B; 200/302

[51] Int. Cl.[2] ..... H01H 13/52

[58] Field of Search .... 200/302, 340, 159 B, 159 R; 197/98

[56] References Cited

UNITED STATES PATENTS

| | | | |
|---|---|---|---|
| 3,054,879 | 9/1962 | Soreng | 200/159 B |
| 3,478,857 | 11/1969 | Linker | 200/302 X |
| 3,586,811 | 6/1971 | Amis et al. | 200/302 |
| 3,603,756 | 9/1971 | Carpentier et al. | 200/159 B |
| 3,829,646 | 8/1974 | Lorteije et al. | 200/159 B |

*Primary Examiner*—James R. Scott

*Assistant Examiner*—William J. Smith

*Attorney, Agent, or Firm*—Craig & Antonelli

[57] ABSTRACT

A push button of rubber or other resilient material for use with a push-button switch and comprising a hollow tilting wall of a mesa shape. The tilting wall of the resilient push button serving as an operating portion is constructed such that its thickness gradually decreases in going from an upper portion toward an intermediate portion and gradually increases in going from the intermediate portion to a lower portion. A curved surface curving inwardly toward the interior of the switch is formed to extend from the intermediate portion to the upper portion. When pressure is first applied to a key top, the curved surface is bent inwardly toward the lower portion of the switch; and when further pressure is applied to the key top, the surface area of the intermediate portion, which is bent inwardly, is increased until the pressure affects the upper portion of the tilting wall. Then, the direction of curving of the curved surface portion is suddenly reversed and the curved surface curves outwardly, whereby the operator can learn by tactile sensation that a switching operation has occurred.

5 Claims, 6 Drawing Figures

PUSH BUTTON BODY FOR A PUSH-BUTTON SWITCH PROVIDING SNAP-ACTION OF THE SWITCH

FIELD OF THE INVENTION

This invention relates to push buttons for push-button switches, using a resilient member, and more particularly it is concerned with a push button for a push-button switch which enables the operator to learn by tactile sensation that a switching operation has occurred when a key top has been pressed.

DESCRIPTION OF THE PRIOR ART

A push-button switch constructed as shown in FIG. 1 in which a hollow resilient body 1 of a mesa shape having attached thereto an electrically conducting material 2 is moved downwardly by depressing a key top 3 so as to thereby force the electrically conducting material into engagement with a printed pattern 4*a* on a printed pattern board 4 has recently been widely in use with electronic table calculators, table-top computers and the like. The resilient body 1 or push button used for this type of push-button switch has a disadvantage in that, since such switch is of a simple mesa shape and uniform in thickness throughout its length as shown in FIG. 1, the switch is not capable of letting the operator learn by tactile sensation that the switch has been actuated when the key top 3 is depressed so as to actuate the switch.

SUMMARY OF THE INVENTION

An object of the invention is to provide a push button for a push-button switch comprising a resilient body having a tilting wall of a mesa shape of ingeneous construction which enables the operator to learn by tactile sensation that the switch has been actuated when the key top is depressed.

Another object of the invention is to provide a push button for a push-button switch of the type described hereinabove in which the tilting wall of the mesa shape consists of an upper portion, a lower portion and an intermediate portion interposed between the upper and lower portions and having a smaller thickness, such intermediate smaller thickness portion being smoothly contiguous with the upper and lower portions and capable of being deformed when brought to an operative position, so as to enable the operator to learn by tactile sensation that the switch has been actuated.

Another object of the invention is to provide a push button for a push-button switch of the type described hereinabove in which a curved surface curving inwardly toward the interior of the switch is formed to extend from the intermediate portion to the upper portion of the tilting wall of the mesa shape, such curved surface being bent inwardly toward the lower portion of the switch when pressure is initially applied to the key top to depress the same and suddenly reversing the direction of curving when further pressure is applied thereto, so that the curved surface curves outwardly whereby the operator can learn by tactile sensation that the switch has been actuated.

DESCRIPTION OF A PREFERRED EMBODIMENT

Figure 1:
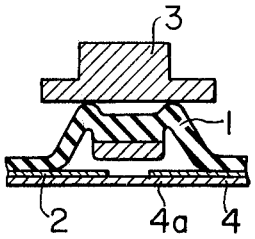
FIG. 1 PRIOR ART
FIG. 1 is a vertical sectional view of a push-button switch using a resilient body of the prior art.
Figure 2:
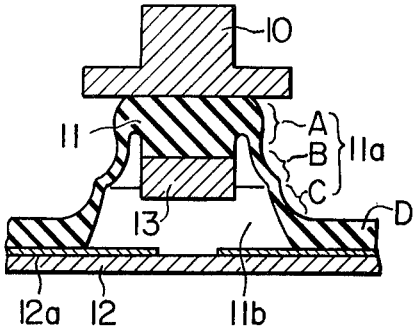
FIG. 2 is a vertical sectional view of a push-button switch using the push button for a push-button switch according to the invention.

FIG. 2 shows a push-button switch employing the push button according to the invention. In the figure, 10 designates a key top, 11 a push-button body, 12 a printed pattern board on which a conductive pattern 12*a* is printed, and 13 an electrically conducting material. The push-button body 11 is formed integrally with a tilting wall 11a of a mesa shape from a resilient material, with the tilting wall 11a consisting of an upper portion A of a larger thickness, a lower portion C of a larger thickness and an intermediate portion B of a smaller thickness interposed between the upper portion A and lower portion C. The thickness of the tilting wall 11a gradually decreases in going from the upper portion A toward the intermediate portion B, and gradually increases in going from the intermediate portion B toward the lower portion C. Normally, the intermediate portion B is formed therein with a curved surface curving inwardly toward the interior of the hollow push button body 11.

Figure 3A:
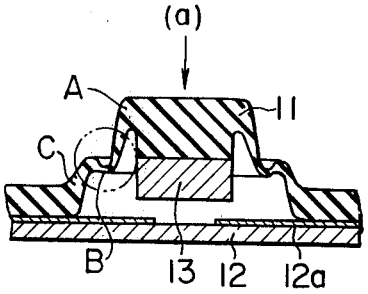
FIG. 3 *a* and FIG. 3 *b* are views in explanation of the operation of the push button shown in FIG. 2.

The operation of the push button shown in FIG. 2 will now be described with reference to FIG. 3 and FIG. 4.

Upon pressure being applied to the key top 11 and the switch body 10 being gradually moved downwardly against the force of restitution exerted by the tilting wall 11*a* on the switch body 11, the smaller thickness intermediate portion B begins to move into a hollow portion 11*b* of the push button body 11 because the upper portion A and the lower portion C of the tilting wall 11a each have a larger thickness. At this time, the direction *b'* of the curving of the curved surface of the intermediate portion B still remains unaltered and the curved surface retains the original shape as shown on an enlarged scale in FIG. 4 *a*.

Figure 4A:
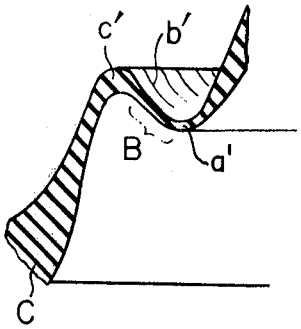
FIG. 4 *a* and FIG. 4 *b* are views, on an enlarged scale, of a broken line portion of FIG. 3 *a* and FIG. 3 *b* respectively.

Application of further pressure to the key top 10 to move the switch body 11 further downwardly causes the intermediate portion B to expand and have its surface area increased to a maximum to form two bending points *a'* and *c'* toward the upper portion A and the lower portion C respectively and on opposite sides of the intermediate portion B, as shown in FIG. 4*a*, so that the intermediate portion B appears as if it were placed up side down. As a result, the direction of curving of the intermediate portion B is suddenly reversed from the normal direction to that shown at *b''* in FIG. 4 *b*. On the other hand, the force of restitution exerted by the tilting wall 11*a* on the push button 11 increases as the stroke of the push button increases until the aforesaid reversing of the direction of curving of the intermediate portion B takes place, and then suddenly decreases after the reversing has taken place. This gives a snap sensation to the finger of the operator depressing the key top 10.

Figure 3B:
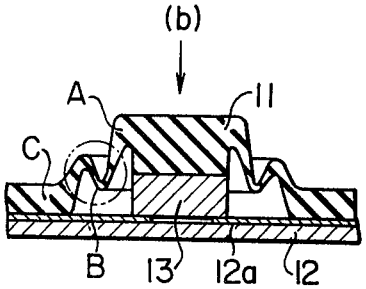
Figure 4B:
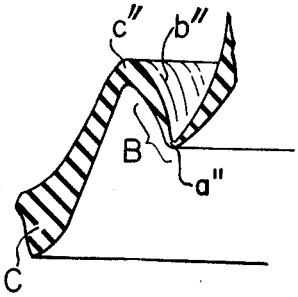

After the reversing of the direction of curving of the intermediate portion B has taken place, the key top 10 is moved downwardly at a stretch by the inertia of the force exerted thereon by the operator to push it down, so that the electrically conducting material 13 is forced into engagement with the conductive pattern 12*a* as shown in FIG. 3b.

When the pressure applied to the key top 10 is removed, the push-button body 11 returns to its original position in virtue of the force of restitution at work between the upper portion A and the intermediate portion B and between the intermediate portion B and the lower portion C to return these portions to their original positions and conditions. In the process of restoration of the push-button body 11 to its original position, the direction of curving of the intermediate portion B is restored from that shown in FIG. 4 *b* to that shown in FIG. 4 *a*. Thus, if the finger of the operator is maintained in contact with the key top 10 with a force which is not large enough to interfere with the returning of the push-button body 11 to its original position, it is possible for the operator to have snap sensation when the push-button body 11 is restored to its original position.

From the foregoing description, it will be appreciated that the push button for the push-button switch according to the invention is simple in construction and yet enables the operator to learn by tactile sensation that the switch has been actuated. Thus, the push button according to the invention is useful for electronic table calculators and the like equipment because the operation of the key top can be facilitated, since the operator can learn by tactile sensation that the switch has been actuated by merely depressing the key top.

What we claim is:

1. A push-button switch comprising a push-button body of a hollow mesa shape, being of a resilient material, and interposed between a key top and a printed pattern board, said push-button body having an inclined wall consisting of an upper portion, an intermediate portion and a lower portion, said inclined wall having a larger thickness at said upper portion and the thickness of the inclined wall being gradually reduced to a minimum thickness at the intermediate portion, the thickness of said inclined wall gradually increasing from said minimum thickness intermediate portion to a larger thickness lower portion, said upper portion, said intermediate portion and said lower portion being smoothly contiguous with one another.

2. A push-button switch as claimed in claim 1 wherein said intermediate portion of the push-button body of the hollow mesa shape is normally gently curved inwardly toward the interior of the push-button body.

3. A push-button switch as claimed in claim 1 wherein said inclined wall of the hollow mesa shaped body is normally always inclined inwardly upwardly.

4. In a push button switch including:

a board for mounting at least two separated electrodes;

a hollow body of elastomeric insulating material having a base portion in which a substantially cylindrical hollow is provided, a frustoconical-shaped portion integrally formed with said base portion at the edge of the cylindrical hollow, and a top surface portion integrally formed with the frustoconical-shaped portion and extending perpendicular to the common axis of said cylindrical hollow and the frustoconical-shaped portion, said hollow body being mounted on said board with said substantially cylindrical hollow being approximately in registry with said two separated electrodes; and a conductive member secured to said top surface portion within the hollow of said hollow body so as to face said two electrodes, the improvement comprising said frustoconical-shaped portion having a minimum thickness portion intermediate of said base portion and said top surface portion in a circumferential direction of the frustoconical-shaped portion, and the thickness of said frustoconical-shaped portion being gradually increased from said minimum thickness portion to both said top surface portion and said base portion, respectively, such that upon a force exerted on said top surface portion a bending point is developed initially at the minimum thickness portion of the hollow body, and rapidly thereafter two bending points are developed in the frustoconical-shaped portion of the hollow body on opposite sides of said minimum thickness portion, thereby providing a smooth snap-action feel to an operator.

5. In a push button switch including a push button body interposed between a key board top and a printed pattern, said push button body being of a resilient material, and said push button body having a base portion with a circular opening, an inclined wall portion integrally formed with said base portion surrounding said circular opening and a top surface portion integrally formed with said inclined wall portion to form a generally frustoconical-shaped structure with a hollow within said inclined wall portion and said top surface portion, the improvement comprising said inclined wall portion having a thickness being large at said base portion, the thickness of the inclined wall portion gradually decreasing to a minimum thickness intermediate of said base portion and said top surface portion, and said thickness of said inclined wall portion gradually increasing from said minimum thickness to a larger thickness at said top surface portion such that a force exerted by said key top on said top surface portion initially bends the intermediate minimum thickness inclined wall portion inwardly into said hollow, and thereafter provides two bending points in said inclined wall portion on opposite sides of said intermediate minimum thickness inclined wall portion.

* * * * *